US005209974A

United States Patent [19]

Martin et al.

[11] Patent Number: 5,209,974

[45] Date of Patent: May 11, 1993

[54] COPOLYMERIC YARNS FOR TEXTURED CARPETS

[75] Inventors: Donald H. Martin, Gulf Breeze; Walter J. Nunning, Pensacola; Scott E. Osborn, Pensacola; James S. Ridgway, Pensacola; Rupert J. Snooks, Jr., Gulf Breeze; John H. Southern, Pensacola, all of Fla.

[73] Assignee: Monsanto Company, St. Louis, Mo.

[21] Appl. No.: 776,935

[22] Filed: Oct. 15, 1991

[51] Int. Cl.[5] ..... D02G 3/00

[52] U.S. Cl. ..... 428/357; 428/362; 428/369; 428/370; 428/371; 57/211; 57/237; 57/238; 57/239; 57/245; 57/244

[58] Field of Search ..... 428/357, 362, 369, 370, 428/371; 57/211, 238, 237, 239, 245, 244; 264/168

[56] References Cited

U.S. PATENT DOCUMENTS

| | | | |
|---|---|---|---|
| 4,238,439 | 12/1980 | Hyun | 264/210 |
| 4,559,196 | 12/1985 | Kobsa et al. | 264/168 |
| 4,601,949 | 7/1986 | Bach et al. | 428/370 |
| 4,729,923 | 3/1988 | Windley | 428/364 |
| 4,740,339 | 4/1988 | Bach et al. | 264/168 |
| 4,919,874 | 4/1990 | Windley | 264/168 |
| 5,058,371 | 10/1991 | Yu et al. | 57/239 |

FOREIGN PATENT DOCUMENTS 9113194 9/1991 PCT Int'l Appl. .

*Primary Examiner*—Patrick J. Ryan
*Assistant Examiner*—N. Edwards

[57] ABSTRACT

Heatset, textured (e.g. stuffer box textured), continuous filament, nylon carpet yarn useful for making textured carpets is disclosed. The yarn is made from nylon 66 copolymer. Textured carpets made from the yarns of the invention have improved aesthetics and/or appearance retention characteristics as compared to textured carpets made from nylon 66 carpet yarns.

4 Claims, No Drawings

COPOLYMERIC YARNS FOR TEXTURED CARPETS

BACKGROUND OF THE INVENTION

This invention relates to carpet yarn useful for making textured cut-pile carpet and, more specifically, to such yarns made from nylon 66 copolymers.

The term "carpet yarn", as used herein, means a yarn consisting of two bulked continuous filament (BCF) singles yarns cabled together. Each singles yarn is individually bulked prior to being cabled together, usually, by jet bulking means.

The term "cut-pile" carpet, as used herein, means a carpet having an evenly sheared pile in the form of short lengths of carpet yarn (tufts). Each tuft projects upwardly and terminates as a cut end.

The term "nylon 66 copolymer", as used herein means a random fiber-forming polymer consisting of two or more different recurring units of which at least 50% by weight and no more than 97% by weight are of the formula:

$$-NH-(CH_2)_6-NH\overset{O}{\overset{\|}{C}}-(CH_2)_4-\overset{O}{\overset{\|}{C}}- \quad \text{(66 units).}$$

The term "nylon 66", as used herein, does not include "nylon 66 copolymers".

Textured cut-pile carpet (hereinafter "textured" carpet) differs from conventional cut-pile carpet in that it is made from textured carpet yarn. One advantage that textured carpet has over conventional cut-pile carpet is that it shows reduced foot prints and reduced vacuum cleaning marks.

In commercial practice, nylon 66 carpet yarn, after being first textured by conventional methods and then heatset, is widely used for textured carpet applications. More specifically, the carpet yarn is fed through a stuffer box apparatus, with or without the use of steam, to compress the yarn. The yarn upon exiting the apparatus is permitted to fall in a wadded-up, crimped form onto the endless stainless steel, perforated belt of a Suberba ® heatsetting machine. The belt passes slowly and continuously through a long chamber filled with saturated steam which is maintained at a temperature of about 138° C. The yarn, after passing through the chamber, is cooled on the belt in its wadded-up, crimped form. The resulting heatset, textured carpet yarn is ready for tufting into textured carpet. (The term "heatset, textured" or "heatset, stuffer-box textured", when used herein with reference to carpet yarn, means that the carpet yarn is heatset after being textured.)

Unfortunately, the aesthetics and appearance retention characteristics of textured carpet made from heatset textured nylon 66 carpet yarn are disappointing. By "aesthetics" is meant the initial ("show room") appearance of the carpet. Factors which contribute to the aesthetics of textured carpet include carpet luster, texture level (tuft cut end to side contrast) and tuft cut end (endpoint) integrity. By "appearance retention" is meant the ability of the carpet to retain its initial appearance and resist matting when subjected to repeated foot traffic.

SUMMARY OF THE INVENTION

The present invention provides a heatset, textured nylon carpet yarn containing from 3.5 to 7.5 turns of cable twist per inch (2.54 cm) and having a Crimp Value of at least 6% and a Shrinkage Value of at least 4%, wherein the nylon is a nylon 66 copolymer. Crimp Values and Shrinkage Values are determined (as hereinafter described) on the carpet yarn before the carpet yarn is textured. Surprisingly, textured carpet made from the nylon 66 copolymer carpet yarn of the invention has improved aesthetics and/or improved appearance retention characteristics as compared to textured carpet made from nylon 66 carpet yarn. It is believed that these improvements are due in part to the fact that nylon 66 copolymer carpet yarn undergoes a greater change in crystalline structure and shrinks more during heatsetting than does nylon 66 carpet yarn.

DETAILED DESCRIPTION OF THE PREFERRED EMBODIMENTS

The heatset, textured, nylon 66 copolymer carpet yarns of the present invention are particularly useful for making textured carpets and may be prepared using the same equipment and procedures that are typically used commercially to prepare heatset, textured, nylon 66 carpet yarns that are presently used for textured carpet applications. Accordingly, an appropriate nylon 66 copolymer is melt-spun to form a singles yarn that is then drawn and bulked (e.g. drawjet textured) under conditions (e.g. time and temperature) selected so as not to degrade the copolymer or cause the filaments of the singles yarn to fuse or melt. (In general, the melting point of nylon 66 copolymer is lower than that of nylon 66.) For textured carpet applications, singles yarn normally have a denier per filament (dpf) in the range of 10 to 26, typically, 5 to 22 and a total denier in the range of 700 to 2000, typically, 1100 to 1500.

Two of the copolymer singles yarns are then cabled together to provide a carpet yarn that is textured (e.g. stuffer box textured) and then heatset (e.g. Superba heatset). The resulting heatset, textured, carpet yarn (hereinafter "final yarn") is ready for tufting into textured carpet. In the cabling operation, sufficient twist is used so as to provide a final yarn containing from 3.5 to 7.5 turns of cable twist per inch (per 2.54 cm). In general, if the final yarn contains less than about 3.5 turns of cable twist per inch (per 2.54 cm), the aesthetics and/or appearance retention characteristics of textured carpet made therefrom are sacrificed. On the other hand, if the final yarn contains more the about 7.5 turns of cable twist per inch (per 2.54 cm), the body of textured carpet made therefrom is sacrificed and the cost of the higher levels of twist in the final yarn adds significantly to the overall cost of the carpet.

One major difference between yarn prepared from nylon 66 copolymer and yarn prepared from nylon 66 is that the copolymer yarn has a Shrinkage Value ranging from 4% to 20% and higher (the magnitude of which depends primarily on the composition of the particular copolymer used in the making of the yarn), whereas the Shrinkage Value of yarn prepared from nylon 66 is in the 2% to less than 4% range.

One similarity between yarn prepared from nylon 66 copolymer and yarn prepared from nylon 66 is that the Crimp Value of both yarns can be varied over a wide range (e.g. 6% to 20%) by selecting appropriate conditions for bulking the singles yarns from which the yarns are made.

In accordance with the present invention, the Shrinkage Value and Crimp Value of the final copolymer yarn are selected so as to achieve the best aesthetics or appearance retention characteristics or combination thereof in textured carpets made therefrom. In general, good results are achieved when the copolymer final yarn has a Crimp Value in the range of 10% to 20% and a Shrinkage Value in the range of 4.5% to 20% with best results being achieved when the Shrinkage values is in the range of 8% to 20%. The particular Crimp and Shrinkage Values required of a specific yarn so as to provide the best results in the textured carpet will depend on the composition of the nylon copolymer yarn.

Preferably, when preparing copolymer final yarns of the present invention, stuffer box texturing methods and Superba heatsetting methods are used. However, if desired, other suitable texturing and/or heatsetting methods may be used.

Nylon 66 copolymers useful in making final yarns of the present invention preferably contain, in addition to nylon 66 units, one or more units selected from the group consisting of:

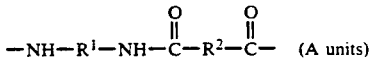

(A units)

and

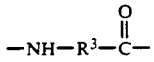

(B units)

where $R^1$, and $R^2$ and $R^3$ are divalent organic radicals. ($R^1$ and $R^2$ are selected so that A units are different from 66 units.)

A units are derived from substantially equimolar amounts of a dicarboxylic acid and diamine and B units are derived from lactams. The copolymers may conveniently be prepared by conventional melt-polymerization techniques commonly used to prepare nylon 66 homopolymer.

Representative $R^1$ and $R^2$ radicals include, for example, $(CH_2)_n$—; where n is a number from 4 to 12;

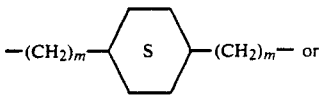

or

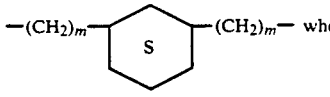

where

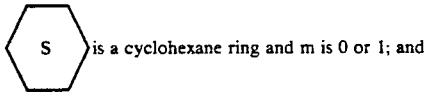

is a cyclohexane ring and m is 0 or 1; and or

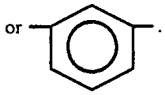

Representative $R^3$ include, for example, —$(CH_2)_5$— and —$(CH_2)_{10}$—. Representative A units include, for example:

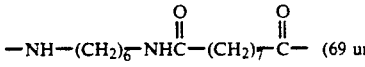

(i)

-continued

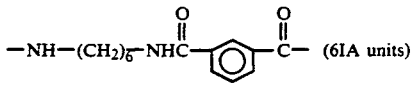

(ii)

(6IA units)

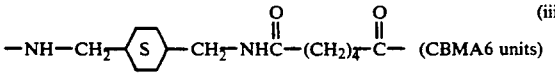

(iii)

(CBMA6 units)

and

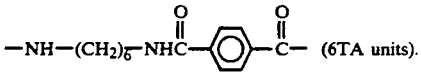

(iv)

(6TA units).

Preferably, the nylon 66 copolymer contains from 50% to 95% by Weight of 66 units and most preferably from 75% to 93% by weight of 66 units. When the concentration of A and/or B units in the copolymer is more than 50% or less than 3% by weight, the benefits of the invention are not significantly realized.

MEASUREMENTS

Shrinkage Values, Crimp Values and Calculated Twist Values of yarn, when given herein, are determined on the carpet yarn before the yarn is textured or heatset by using the following procedure.

The carpet yarn is conditioned at 23° C. and 72% relative humidity for one day prior to testing. Using a Suter denier reel or the equivalent and a winding tension of 0.033 grams per yarn denier, the yarn is wound into a skein having a 1.125 meter circumference with the number of revolutions (n) taken on the denier reel being determined by the formula:

$$n = 27{,}222 \text{ divided by denier of the carpet yarn}$$

where n is rounded off to the nearest whole number. The ends of the skein are tied together while maintaining the 0.033 grams per denier tension, and the skein having a length of 56.25 cm is removed from the denier reel and suspended from a rod. A number 1 paper clip, bent into an "S" shape is suspended from the skein. The rod with skein and paper clip attached is placed in an oven maintained at a 100° C. with saturated steam. The oven is sufficiently large so that the skein hangs freely. After one minute in the oven, the rod with skein and paper clip is removed from the oven and hung in an atmosphere of 23° C. and 72% relative humidity for one minute. Then, the rod with the skein and paper weight is again placed in the oven. This time saturated steam is used to maintain the oven at 138° C. It is understood that, if the melting point of the yarn is such that the filaments of the yarn stick to one another when a temperature of 138° C. is used, a temperature is then selected and used which is 5° C. below the temperature at which sticking of the filaments occur. After three minutes in the oven, the rod with skein and paper clip is removed from the oven and again hung in an atmosphere of 23 C. and 72% relative humidity for one minute. Next, a weight equal to 0.9 mg per skein denier is then gently suspended from the paper clip and after an additional 30 seconds, the skein length in centimeters is again measured and recorded this time as $L_1$. The small weight is then replaced with a weight to give 83.4 mg per skein denier and after an additional 30 seconds, the skein length in centimeters is once again measured, and recorded this time as $L_2$.

$$\text{Shrinkage Value } (\%) = 100(56.25 - L_2) \div 56.25$$

$$\textit{Crimp Value } (\%) = 100(L_2 - L_1) \div L_2$$

$$\textit{Calculated Twist Value} = I_T(56.25) \div L_1$$

$I_T$ = *turns of cable twist per inch (cm)* initially used to cable the singles yarns together (inserted twist)

EXAMPLE

This example illustrates preparation of nylon 66 copolymer final yarns of the invention and textured carpet made using such yarns. Two bulked (draw-jet-textured) continuous filament (1320 denier/60 filament), 2.6 MR (modification ratio), nylon 66 singles yarns were prepared in a conventional manner and cabled together with 4.25 turns per inch (2.54 cm) of twist (inserted twist) in the S-direction to provide a cabled yarn (Control-1). A second control cabled yarn (Control-2) was made using slightly different jet texturing conditions. Additional cabled yarns having the same nominal denier and filament count as the control yarns were made as described except that in each instance, instead of the singles yarns being made from nylon 66, the singles yarns were made from a nylon 66 copolymer. Each cabled yarn was then passed through a stuffer box crimper without using steam and was then heatset using Superba equipment and 138° C. saturated steam to provide a final yarn. The yarns were in contact with the steam in each instance for a period of three (3) minutes. To illustrate the invention, the jet texturing conditions (e.g. temperature, pressure and jet dimensions) used to prepare the singles yarns were varied within usable ranges so as to provide final yarns having different Shrinkage and Crimp Values. The Crimp Value, Shrinkage Value and Calculated Twist Value of each of the final yarns were determined.

Each final yarn was then tufted into a textured carpet using the following construction:

(a) gauge (spacing between rows of tufts)—5/32 inch (0.4 cm)
(b) face weight—spacing between stitches was selected to provide 28 oz/yd$^2$ (950.2 g/m$^2$)
(c) pile height—⅝ inch (1.6 cm)
(d) backing—primary and secondary backings were polypropylene backings
(e) each carpet was beck dyed to a beige color using conventional equipment and conditions.

The aesthetics of each of the carpets made from the copolymer yarns was visually compared to that of the carpets made from Control yarns. In making the comparison, luster, carpet texture level and tuft end point definition were considered. Each carpet was also subjected to 20,000 traffics where each traffic was the occurrence of an individual walking across the carpet. After trafficking, the appearance retention of the carpets made from the copolymer yarns were visually compared to that of Control yarns.

The results of the carpet tests along with the comparison and properties of the carpet yarns used to prepare the test carpets are given in the table to follow. In the table, the aesthetics (I) and appearance retention (J) of the carpets are rated either "0" (the same as), "+" (better than) or "++" (much better than carpets made from Control-I yarn).

TABLE

TEXTURED CARPET COMPARISONS

| A | B | C | D | E | F | G | H | I | J |
|---|---|---|---|---|---|---|---|---|---|
| Control-I | 100 | 0 | 0 | 0 | 11.5 | 3.8 | 1.96 | 0 | 0 |
| Control-II | 100 | 0 | 0 | 0 | 13.3 | 2.4 | 1.98 | 0 | 0 |
| R | 99.5 | 0.5 | 0 | 0 | 10.2 | 2.04 | 1.90 | 0 | 0 |
| S | 95 | 5 | 0 | 0 | 9.13 | 6.5 | 1.97 | + | + |
| T-1 | 95 | 2.5 | 2.5 | 0 | 11.2 | 4.7 | 1.98 | 0 | + |
| T-2 | 95 | 2.5 | 2.5 | 0 | 12.7 | 4.5 | 2.0 | + | + |
| T-3 | 95 | 2.5 | 2.5 | 0 | 11.4 | 5.2 | 2.00 | 0 | + |
| U-1 | 95 | 5 | 0 | 0 | 11.7 | 7.9 | 2.06 | + | + |
| U-2 | 95 | 5 | 0 | 0 | 12.8 | 5.2 | 2.02 | + | + |
| U-3 | 95 | 5 | 0 | 0 | 10.9 | 8.8 | 2.06 | 0 | + |
| V-1 | 90 | 2.5 | 7.5 | 0 | 11.4 | 6.7 | 1.93 | 0 | + |
| V-2 | 90 | 2.5 | 7.5 | 0 | 13 | 7.2 | 2.07 | + | + |
| W-1 | 90 | 5 | 5 | 0 | 12.6 | 7.2 | 2.06 | + | + |
| W-2 | 90 | 5 | 5 | 0 | 13.6 | 4.9 | 2.04 | + | + |
| X-1 | 90 | 7.5 | 2.5 | 0 | 13.8 | 8.3 | 2.11 | ++ | + |
| X-2 | 90 | 7.5 | 2.5 | 0 | 13.8 | 8.8 | 2.13 | + | + |
| X-3 | 90 | 7.5 | 2.5 | 0 | 11.8 | 9.3 | 2.09 | 0 | + |
| Y-1 | 85 | 7.5 | 7.5 | 0 | 13.8 | 7.2 | 2.09 | ++ | + |
| Y-2 | 85 | 7.5 | 7.5 | 0 | 14.5 | 5.6 | 2.07 | ++ | + |
| Y-3 | 85 | 7.5 | 7.5 | 0 | 13.3 | 7.7 | 2.09 | + | + |
| Z-1 | 85 | 7.5 | 0 | 7.5 | 15.7 | 11.6 | 2.24 | ++ | + |
| Z-2 | 85 | 7.5 | 0 | 7.5 | 15.0 | 12.5 | 2.25 | ++ | + |
| Z-3 | 85 | 7.5 | 0 | 7.5 | 16.6 | 16.2 | 2.39 | ++ | + |

A = Carpet Yarn
Carpet Yarn Composition
B = N66 (%)
C = N6 (%)
D = N6TA (%)
E = N6IA (%)
Carpet Yarn Properties
F = Crimp Value %
G = Shrink Value %
H = Calculated Twist Value (TPC)
Carpet Properties
I = Aesthetics
J = Appearance Retention The results in the Table show that textured carpet made from the nylon 66 copolymer final yarn of the present invention have better aesthetics and/or better appearance retention characteristics than textured carpets made from nylon 66 final yarn. See Carpet Yarns (X-1), (Y-1), (Y-2), (Z-1), (Z-2) and (Z-3). The results show that the best results are obtained when the Crimp Value of the copolymer final yarn is at least 10 and the Shrinkage Value is at least 5.

What is claimed is:

1. A heatset, stuffer-box textured, carpet yarn consisting of two singles yarns cabled together with from 3.5 to 7.5 turns of twist per inch (2.54 cm), wherein each said singles yarn consisting essentially of bulked continuous filaments composed of a nylon copolymer consisting of recurring units selected from the group consisting of:

$$-NH-R^1-NHC(O)-R^2-C(O)-, \quad \text{(i)}$$

$$-NH-R^3-C(O)- \quad \text{(ii)}$$

and $$-NH-(CH_2)_6-NHC(O)-(CH_2)_4-C(O) \quad \text{(iii)}$$

wherein $R^1$, $R^2$ and $R^3$ are divalent organic radicals with the proviso that $R^1$ and $R^2$ are selected such that (i) units are different from (iii) units and wherein from 75% to 93% of the recurring units are (iii) units.

2. The carpet yarn of claim 1 wherein said recurring units comprise units of the formula

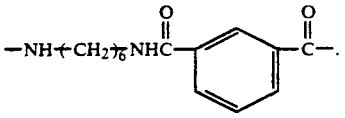
3. The carpet yarn of claim 1 wherein said recurring units comprise unit of the formula
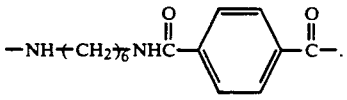
4. The carpet yarn of claim 1 wherein said recurring units comprise units of the formula
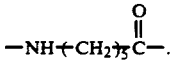
* * * * *